US011447995B2

(12) United States Patent
Lygin

(10) Patent No.: US 11,447,995 B2
(45) Date of Patent: Sep. 20, 2022

(54) DEVICE FOR MOVING A DOOR LEAF

(71) Applicant: dormakaba Deutschland GmbH, Ennepetal (DE)

(72) Inventor: Konstantin Lygin, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 0 days.

(21) Appl. No.: 17/110,394

(22) Filed: Dec. 3, 2020

(65) Prior Publication Data

US 2021/0180380 A1 Jun. 17, 2021

(30) Foreign Application Priority Data

Dec. 11, 2019 (EP) ..... 19215427

(51) Int. Cl.
*E05F 1/00* (2006.01)

(52) U.S. Cl.
CPC ..... *E05F 1/00* (2013.01); *E05Y 2201/626* (2013.01); *E05Y 2201/684* (2013.01); *E05Y 2900/132* (2013.01)

(58) Field of Classification Search
CPC ..... E05C 17/02; E05C 17/54; E05C 17/34; E05C 17/32; E05F 3/22; E05F 3/221; E05F 3/227; E05F 1/08; E05F 1/00; E05F 1/002; E05F 1/006; E05F 1/008; E05F 2003/228; E05F 2015/631; E05F 15/63; E05Y 2900/132; E05Y 2201/626; E05Y 2201/624; E05Y 2201/684; Y10T 16/469; Y10T 16/459; Y10T 16/462; Y10T 16/27; Y10T 16/286; Y10T 16/299; Y10T 16/56; Y10T 16/577; Y10T 16/585; Y10T 16/61
See application file for complete search history.

(56) References Cited

U.S. PATENT DOCUMENTS 3,909,876 A * 10/1975 Zunkel ..... E05F 3/00 16/71
4,287,639 A * 9/1981 Denton ..... E05F 3/22 16/48.5
5,551,740 A * 9/1996 Lin ..... E05F 3/221 292/262
10,871,015 B1 * 12/2020 Rioux ..... E05C 17/34
2014/0143979 A1 * 5/2014 Winkler ..... E05F 3/22 16/71
2014/0165329 A1 * 6/2014 Wildforster ..... E05F 3/227 16/71
2016/0369545 A1 * 12/2016 Bell ..... E05F 3/227
(Continued)

FOREIGN PATENT DOCUMENTS

AT 11822 U1 5/2011
CN 105442978 A * 3/2016 ..... E05F 15/63
(Continued)

*Primary Examiner* — Chuck Y Mah
(74) *Attorney, Agent, or Firm* — Cantor Colburn LLP

(57) ABSTRACT

A device for moving a door leaf between an open position and a close position with regard to a door opening in a wall includes lever kinematics with a lever for assisting the movement of the door leaf. The lever includes a first section and a second section, and a connecting element for accommodating a transmission component configured for transmitting electrical energy and/or data. The device is provided for the connecting element to be rotatably supported at the first section of the lever.

17 Claims, 10 Drawing Sheets

(56) References Cited

U.S. PATENT DOCUMENTS

| | | | | |
|---|---|---|---|---|
| 2020/0340280 | A1* | 10/2020 | Oakley | E05F 3/227 |
| 2021/0071458 | A1* | 3/2021 | Eickhoff | E05F 3/227 |

FOREIGN PATENT DOCUMENTS

| | | | | | |
|---|---|---|---|---|---|
| CN | 107227907 | A | * | 10/2017 | |
| EP | 3064694 | A1 | * | 9/2016 | E05F 3/22 |
| EP | 3460155 | A1 | | 3/2019 | |
| JP | 2002256757 | A | * | 9/2002 | |

* cited by examiner

DEVICE FOR MOVING A DOOR LEAF

CROSS-REFERENCE TO RELATED APPLICATIONS

This application is related to and claims the benefit of European Patent Application No. 19 215 427, filed on Dec. 11, 2019, the contents of which are herein incorporated by reference in their entirety.

TECHNICAL FIELD

The following disclosure relates to a device for moving a door leaf between an open position and a close position according to the generic part of the independent device claim. Furthermore, the disclosure relates to a system for moving a door leaf between an open position and a close position with a corresponding device and a guiding rail according to the generic part of the independent system claim. Moreover, the disclosure relates to a method for mounting a corresponding device according to the generic part of the independent method claim.

BACKGROUND

Systems are known for moving a door leaf between an open position and a close position by means of lever kinematics and a guiding rail. Hereby most of the time, the lever kinematics includes a lever, which at a first section, for example at the casing side, is rotatably connected to a sliding member, which can be linearly movably accommodated in a guiding rail. Depending on the mounting type of the lever kinematics the relative rotation between the sliding member and the lever amounts to about 30° on the pull side and to about 60° on the push side. In case the lever kinematics is disposed at a DIN left-handed or a DIN right-handed door leaf, in addition the relative direction of rotation reverses between the sliding member and the lever. Consequently, the relative movement between the sliding member and the lever can amount to up to about 120°.

In case a transmission means, for example in the shape of a cable, for transmitting electric energy and/or data to the guiding rail, is to be realized via the lever kinematics, the relative rotation between the sliding member and the lever represents a structural limitation, because the corresponding movement of the connecting element for the transmission means often may not be possible at the lever as the inside of the sliding member lacks construction space. The construction space is not sufficient for turning the sliding member by 120° in relation to the lever, because within the provided functional reception, the connecting element would collide with the guiding rail and would break.

As a consequence, two variants of lever kinematics are required with the stationary connecting element, one for a DIN-left handed door leaf and one for a DIN right-handed door leaf.

SUMMARY

Therefore, the present disclosure overcomes at least partly the above-described disadvantages in a device for moving a door leaf between an open position and a close position. In particular, the present disclosure provides a device for moving a door leaf between an open position and a close position, which is designed in a simple and inexpensive manner, which allows for quick and simple mounting and/or which allows for a flexible use of the device with a DIN left-handed or a DIN right-handed door leaf, on a pull side or on a push side of the door leaf. Furthermore, the disclosure provides a corresponding system for moving a door leaf between an open position and a close position with a corresponding device. Moreover, the disclosure allows for a simple and comfortable method for mounting a corresponding device at a DIN left-handed or a DIN right-handed door leaf, on a pull side or on a push side of the door leaf.

The disclosure provides a device for moving a door leaf between an open position and a close position having the features of the independent device claim, in particular from the characterizing part. Furthermore, the disclosure provides a system for moving a door leaf between an open position and a close position with a corresponding device, a sliding member and a guiding rail having the features of the independent system claim. Moreover, the disclosure provides a method for mounting a corresponding device having the features of the independent device claim, in particular from the characterizing part.

The disclosure provides a device for moving a door leaf between an open position and a close position with regard to a door opening in a wall, including: Lever kinematics with a lever for assisting the movement of the door leaf, wherein the lever includes a first, respectively casing-sided, section preferably for establishing an operative connection of the lever kinematics to a guiding rail, and a second, respectively drive-sided, section preferably for establishing an operative connection of the lever kinematics to a drive, and a connecting element for accommodating a transmission means for transmitting electric energy and/or data, preferably between a casing-sided energy source and a drive-sided energy recipient. For this purpose according to the disclosure, it is provided for the connecting element to be able to be disposed at least at a first start position and at a second start position at the first section of the lever.

In this case, the inventive idea is to keep the construction space small, which needs to be provided within the sliding member for the connecting element, by placing the connecting element at least at two different start positions. Thus, by placing the connecting element one time at the first start position and another time placing the connecting element at the second start position, the same construction space in the sliding member can be used for a different range of rotation of the lever and the sliding member with regard to each other. Thus, the lever and the sliding member can perform a large relative movement with regard to each other, without a risk of breaking the connecting element. In particular, when using the device at a DIN left-handed door leaf, it can be provided for the connecting element to be located at least partly in the first start position, and when using the device at a DIN right-handed door leaf, the connecting element can be located at least partly in the second start position. In particular, when using the device at a DIN left-handed door leaf, it can be provided for the connecting element to be located in the first start position, and when using the device at a DIN right-handed door leaf, the connecting element can be located in the second start position. The first and the second start positions indicate positions of the connecting element in relation to the lever. In the first and in the second start positions, the connecting element is reversibly releasably attached to the lever. Thus, in the first and in the second start positions, the connecting element can be attached positively and/or non-positively to the lever.

The device can comprise transmission means.

It is possible for the connecting element to be rotatably supported at the lever between the first and the second start positions. Preferably, it is provided for the connecting element to be rotatably supported at the first section of the lever. The rotatable support of the connecting element at the lever creates an additional degree of freedom for flexibly mounting the connecting element in conjunction with a DIN left-handed door leaf or a DIN right-handed door leaf, on a pull side or on a pull side of the door leaf. Preferably, the connecting element is supported in a range of maximum +/−55°, preferably of maximum +/−50°, particularly preferred of maximum +/−40° with regard to the longitudinal extension axis of the lever. Thus resulting in a rotatability of maximum 110°, preferably of maximum 100°, particularly preferred of maximum 80° of the connecting element to the lever. In this way, the necessary turning of the sliding member in relation to the lever by a minimum of 120° (respectively in a range of +/−60°) is possible in a particularly simple manner. Hereby, the turnability for the sliding member in relation to the lever results from the sum of the turning possibility of the connecting element to the lever and a turning possibility of the connecting element within the sliding member. For this purpose, the sliding member can comprise a functional reception.

The possibility of turning the connecting element in relation to the lever allows for manually bringing the connecting element into a necessary start position and/or the sliding member can automatically turn it, which position is optimal for the respective mounting type. The respective mounting type can comprise mounting to a DIN left-handed or a DIN right-handed door leaf, on a pull side or on a push side of the door leaf. Advantageously for this purpose, the sliding member and/or the guiding rail do not require any modifications. Only the adjustability of the connecting element with regard to the lever allows for the additional freedom of mounting.

The lever can comprise at least one abutment in order to delimit the movement of the connecting element. Hereby avoiding too high a stress for the transmission element. Preferably, the lever can comprise first and second abutments, in order to delimit the movement of the connecting element. In the first start position the connecting element can be disposed near the first abutment and/or closer to the first abutment than to the second abutment. In the second start position the connecting element can be disposed near the second abutment and/or closer to the second abutment than to the first abutment.

The connecting element can comprise an adapter element. The first section of the lever can comprise a guide. The connecting element, in particular the adapter element can be rotatably supported along the guide at the first section of the lever. In this way, the adapter element can be allowed to be rotatably supported at the lever, however not be removed unintentionally from the lever. In the direction of the axis of rotation of the connecting element, the connecting element, in particular the adapter element can be positively retained in the guide. For example, the connecting element, in particular the adapter element, can engage behind the guide.

The adapter element can comprise at least one sliding element. Preferably, the sliding element is rotatably attached to or in the guide. The sliding element can be rotatably accommodated in or at the guide. Thus, the advantage can be achieved for the adapter element to be simply and comfortably supported in a rotatable manner at the first section of the lever. For example, the sliding element can comprise a projection, which engages behind a circular or circle segment shaped projection of the guide. The sliding element can be clipsed for example to the guide.

Preferably, the adapter element is rotatable in a range of maximum +/−45°, in particular of maximum +/−30° in terms of the longitudinal extension axis of the lever. For example, the first and the second abutments can delimit said range in the guide at the first section of the lever.

The connecting element can comprise a guiding element.

The connecting element can be formed in several parts. Preferably, the adapter element and the guiding element are reversibly releasably connected to each other. The adapter element and the guiding element can be positively and/or non-positively connected to each other. For example, the guiding element is inserted or clipsed into the adapter element.

Furthermore, in a device for moving a door leaf between an open position and a close position, the disclosure can provide for the adapter element for supporting the guiding element to be provided at the first section of the lever. Advantageously, the adapter element can be embodied to attach the guiding element. In this case, the adapter element can include engagement geometry in order to allow for a simple attaching, respectively inserting of the guiding element at the adapter element.

Advantageously, the adapter element can be formed for positioning the connecting element in a start position at the lever, depending on the mounting type.

Advantageously, it is conceivable for the connecting element to be rotatably supported at the lever at least between the two start positions. Preferably, the at least two different start positions can allow for mounting to a DIN left-handed or to a DIN right-handed door leaf. For example, the first and the second abutments in the guide at the first section of the lever can specify the start positions. For example, the abutments can be located in a range of maximum +/−45°, in particular of maximum +/−30° with regard to the longitudinal extension axis of the lever.

Furthermore, the disclosure can provide in a device for moving a door leaf between an open position and a close position that the device comprises a storage unit for accommodating a length of the transmission means, in order to allow for adjusting the transmission means at the first section of the lever, when turning the connecting element. The additional degree of freedom when turning the connecting element in relation to the lever can require adjusting the transmission means. In this case, the length of the transmission means, which is provided for adjusting the transmission means, can be accommodated protected in the storage unit. In particular, the transmission means rests loosely in the storage unit. In this case, the storage unit can be differently embodied.

Within the scope of the disclosure, it is conceivable for the storage unit to be formed in the shape of a circle segment shaped groove in the first section of the lever, which in particular extends around an axis of rotation of the lever with regard to the guiding rail. Thus, the storage unit can be incorporated within the lever, in order to allow for an elegant and simple construction type of the storage unit. Hereby, it is conceivable for the length of the transmission means, which is accommodated in the circle segment shaped groove for adjusting the transmission means, to be folded in a loop shape, respectively U shape, meander or accordion shape.

Moreover, within the scope of the disclosure, it is conceivable for the storage unit to be formed in the shape of a linear groove in the lever, which in particular extends along an extension axis of the lever. In this way, the storage unit as well can be incorporated within the lever, wherein the storage unit can be formed along the extension axis of the lever. Thus again, the storage unit can have a simple construction type. Hereby likewise, it is conceivable for the length of the transmission means, which is accommodated in the circle segment shaped groove for adjusting the transmission means, to be folded in a loop shape, respectively U shape, meander shape or accordion shape.

Moreover, within the scope of the disclosure, it is conceivable for the storage unit to be formed in the shape of a reception at a separate add-on piece, in particular supported rotationally mobile at the lever, in particular for the first section of the lever. Thus, the storage unit can be provided as an upgrade component. This is in particular advantageous in case of retrofitting the inventive device to existing sliding rail arm assemblies.

Furthermore, in a device for moving a door leaf between an open position and a close position, the disclosure can provide for a length of the transmission means, which is accommodated in the storage unit, to be formed loop-shaped respectively U-shaped, meander-shaped and/or accordion-shaped. Thus, the length of the transmission means, which is provided for adjusting the transmission means, can be stowed in a construction space saving manner in the storage unit.

Furthermore, in a device for moving a door leaf between an open position and a close position, the disclosure can provide for the lever to include a guiding groove for the transmission means. Thus, the transmission means can be disposed countersunk in the lever arm. Moreover, it is conceivable for the lever arm to include a groove cover for the transmission means, in particular for the guiding groove. Thus, the transmission means can be covered, and protected against manipulations and/or environmental influences, without compromising the appearance of the device.

Advantageously, the lever can include a core, in particular a metal core, and a housing, in particular a plastic material housing, wherein in particular the guiding groove can be formed between the core and the housing. Consequently, a stable and functional construction type of the lever kinematics can be provided. As an alternative or in addition, the guiding groove can be formed within the housing. It is conceivable in a first section of the guiding groove, the guiding groove be formed within the housing and in a second section of the guiding groove, the guiding groove be formed between the core and the housing. The groove cover can be formed as a part of the housing.

Moreover, in a device for moving a door leaf between an open position and a close position, the disclosure can provide for the connecting element to include a plug-in guide for the transmission means, wherein in particular the plug-in guide can be embodied to deflect the transmission means at least once, preferably twice, in particular by 90°, and/or to fold it back over once, preferably twice, in particular by 45°. Again, folding back the transmission means can serve to deflect a transmission means having the shape of a flat cable with regard to the longitudinal axis thereof. Deflecting and folding back the transmission means at least once, preferably twice can allow for laying the transmission means via a linking by legs between the lever and the guiding rail on different levels, caused by the construction height of the lever and the guiding rail. Moreover advantageously, the plug-in guide can serve for allowing strain relief at the transmission means. In particular, the guiding element can comprise the plug-in guide.

Moreover, in a device for moving a door leaf between an open position and a close position, the disclosure can provide for the transmission means to be configured at least in sections as a flat cable, flat ribbon cable or as a flexible printed circuit board. A flat cable, respectively a flat ribbon cable is a multiple-wire cable, in which the individual conductors are laid parallel next to each other. Multiple-wire flat ribbon cables have the advantage of connecting several conductors at once, instead of soldering them individually in an insulated manner. It is likewise conceivable for the flat cables, respectively flat ribbon cables to be configured with a shielding, which in particular can comprise aluminium or copper film. A flexible printed circuit board can be a printed circuit, which in particular is built up on flexible plastic material carriers. In this case, copper can be employed as the conductor material. Moreover, likewise round cables are conceivable as the transmission means, which have a circular cross-section, and in which the individual conductors are disposed in a round manner around the centre.

Furthermore, in a device for moving a door leaf between an open position and a close position, the disclosure can provide for the transmission means to include at least one, preferably two deflection points, in particular by 90°, and/or at least one, preferably two fold back points, in particular by 45° at the connecting element. In this way, the transmission means can be affixed to the connecting element without additional attachment means as well as under strain relief. Moreover in this way, the transmission means can be deflected between different construction levels of the guiding rail and of the lever without destruction and preferably without overextension and/or compression.

Furthermore, the disclosure provides a system for moving a door leaf between an open position and a close position with regard to a door opening in a wall, including: A device, which can be embodied as described above, a sliding member and a guiding rail, in which the sliding member is movably accommodated, wherein the sliding member is rotatably connected to the first section of the lever. In a rotatable connection of the sliding member to the first section of the lever, the connecting element is able to turn in relation to the sliding member and thus to the guiding rail. In this case, the connecting element can be accommodated at the sliding member in a functional reception, which in particular has the shape of a circle segment, in order to allow for moving the connecting element in relation to the sliding member. Moreover, the inventive system allows for achieving the same advantages, which are described above in conjunction with the inventive device. Presently, reference is fully made to said advantages.

Moreover, in a system for moving a door leaf between an open position and a close position, the disclosure can provide for the sliding member to include a functional reception, which in particular has a circle segment shape, for the connecting element, in order to allow for displacing the connecting element during a rotary movement of the lever in relation to the sliding member. Thus, despite the movable arrangement of the lever with regard to the guiding rail, the transmission means can be laid in that the transmission means passes through the connecting element at the rotary transition between the lever and the sliding member.

It is possible for the functional reception to include a sidewall. The sidewall can delimit the movement of the connecting element. With the functional reception resting at the sidewall, the connecting element can be movable from a start position to a further start position. Thus, during mounting or operation, it can be possible for the movement of the connecting element to rest at the sidewall, while the lever is moved such as to press the connecting element against the sidewall. Hereby, the position of the connecting element changes in relation to the lever. Hereby, preventing the connecting element from breaking. The connecting element continues to change the position towards the lever for so long until the lever is moved in a direction of rotation, in which the connecting element is pressed against the sidewall. When the direction of rotation of the lever changes, the connecting element leaves the sidewall and moves together with the lever. Now, the connecting element remains in the thus found position. Hereby, friction contact can keep the connecting element in the position found towards the lever.

In particular, the functional reception can comprise a first sidewall and a second sidewall. The first and the second sidewalls can delimit the movement of the connecting element. The connecting element resting at the first sidewall, can be moved from the first into the second start position. The connecting element resting at the second sidewall can be moved from the second into the first start position.

In particular, it can be provided for the connecting element to remain in the start position, when operating the device and/or of the system. This means, only when mounting the connecting element has to occupy a start position. During operation, the connecting element can remain in the occupied start position. A movement of the connecting element in the functional reception is sufficient in the mounted condition. In particular, the connecting element moves back and forth within the functional reception when the device is operated.

When the connecting element is rotatably supported at the first section of the lever, as an alternative, it is possible for the connecting element to leave the selected start position, when the device is operated. Hereby allowing compensating e.g. for fault tolerances.

The connecting element moves between a first end location and as second end location within the functional reception when opening the door. At least when opening the door up to a large opening angle, in particular an opening angle of at least 100°, the connecting element moves within the functional reception back and forth between the first end location and the second end location. The first end location and the second end location designate the state of the connecting element in relation to the sliding member.

Moreover, in a system for moving a door leaf between an open position and a close position, the disclosure can provide for the sliding member to include a rotary reception for a rotary head of the lever, in order to allow fora rotary movement of the lever in relation to the sliding member. Thus, the rotary head can serve for allowing a rotatable and displaceable connection between the lever and the guiding rail. Moreover, it is conceivable the rotary reception within the sliding member be formed continuous with the functional reception. This allows for a simple formation of the rotary reception and the functional reception.

Advantageously, it is conceivable for the transmission means to be guided centrally through the rotary reception at the sliding member for a rotary head of the lever. Thus, during a rotary movement of the lever in relation to the sliding member, it can be allowed for the transmission means to be treated with greatest care, in particular not to be stretched or compressed.

Furthermore, in a system for moving a door leaf between an open position and a close position, the disclosure can provide for the sliding member to include a guiding unit for the transmission means. Advantageously, the guiding unit can be provided following the functional reception for the connecting element and following the rotary reception for a rotary head of the lever, prior to introducing the transmission means into the guiding rail. Advantageously, the guiding unit can serve for preventing the transmission means from an unwanted movement out of the sliding member. In particular, the guiding unit can serve as a loose bearing for the transmission means. In particular, the connecting element can serve as a fixed bearing for the transmission means.

Furthermore, in a system for moving a door leaf between an open position and a close position, the disclosure can provide for the transmission means to include a loop-shaped section, which is disposed in the guiding rail in order to allow the transmission means to follow when moving the sliding member along the guiding rail. In a simple way, the loop-shaped section of the transmission means ensures strain-free length compensation and ensures the sliding member can travel along the guiding rail without hindering transmitting electric energy and/or data through the transmission means.

Furthermore, the disclosure provides a method for mounting a device for moving a door leaf between an open position and a close position with regard to a door opening in a wall, which can be embodied as described-above, including: Lever kinematics with a lever for assisting the movement of the door leaf, wherein the lever includes a first, respectively casing-sided section preferably for establishing an operative connection of the lever kinematics to a guiding rail, and a second, respectively drive-sided section preferably for establishing an operative connection of the lever kinematics to a drive, a connecting element for accommodating a transmission means for transmitting electric energy and/or data, preferably between a casing-sided energy source and a drive-sided energy recipient. According to the disclosure for this purpose, it is provided for the connecting element to be disposed in a first start position intended for the connecting element or in a second start position intended for the connecting element, at a first section of the lever, in order to adapt the device to a DIN left-handed or to a DIN right-handed door leaf, on a pull side or on a push side of the door leaf. In particular, the connecting element is rotatably supported at a first section of the lever, in order to be able to flexibly dispose the device at a DIN left-handed or to a DIN right-handed door leaf, on a pull side or on a push side of the door leaf. Moreover, the inventive method achieves the same advantages, which are described-above in conjunction with the inventive device and/or with the inventive system. Presently, reference is fully made to said advantages.

BRIEF DESCRIPTION OF THE DRAWINGS

Hereinafter, further measures enhancing the disclosure will be illustrated in detail in the following in conjunction with the description of the preferred exemplary embodiments of the disclosure based on the Figures. In this case, the features mentioned in the claims and in the description can be essential to the disclosure individually or in any arbitrary combination. In this case, it should be noted that the Figures do have a descriptive character only and are not intended to delimit the disclosure in any way. It shows:

DETAILED DESCRIPTION OF THE DRAWINGS

Figure 1:
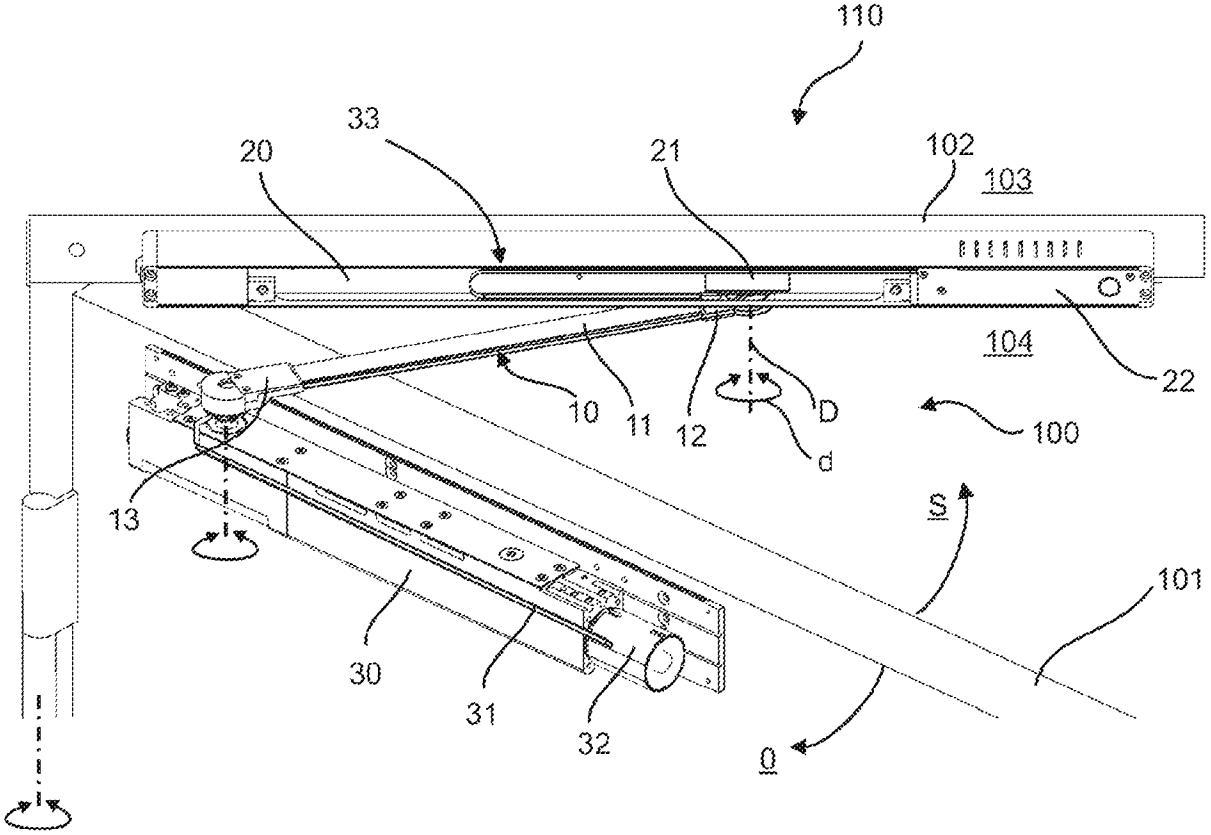
FIG. 1 a diagrammatic illustration of an inventive device and of the inventive system in the mounted condition in a potential mounting state with regard to a door leaf, FIG. 2 a diagrammatic illustration of an issue, on which the disclosure is based, wherein the upper three illustrations show the disclosure and the lower three drawings illustrate a conceptual experiment, FIG. 3 an enlarged illustration of a section of the inventive device and of the inventive system of FIG. 1 in the area of a rotary transition to a guiding rail, FIG. 4 a diagrammatic illustration of a section of the inventive device of FIG. 3 underneath a sliding member, FIG. 5 an advantageous configuration of the inventive device, in particular of a device according to FIG. 4, FIG. 6 different advantageous configurations of an inventive device, FIG. 7 a diagrammatic illustration of a transmission means of the inventive device of the preceding Figures, FIG. 8 individual parts of the inventive device of FIG. 4, FIGS. 9, 10 a second exemplary embodiment of the inventive device and of the inventive system in a DIN L mounted door, and FIGS. 11, 12 the second exemplary embodiment in a DIN R mounted door.

Throughout the different Figures, same parts of the device 100 and of the system 110 are always identified with the same reference numerals, and therefore, normally they will be only described once.

Figure 3:
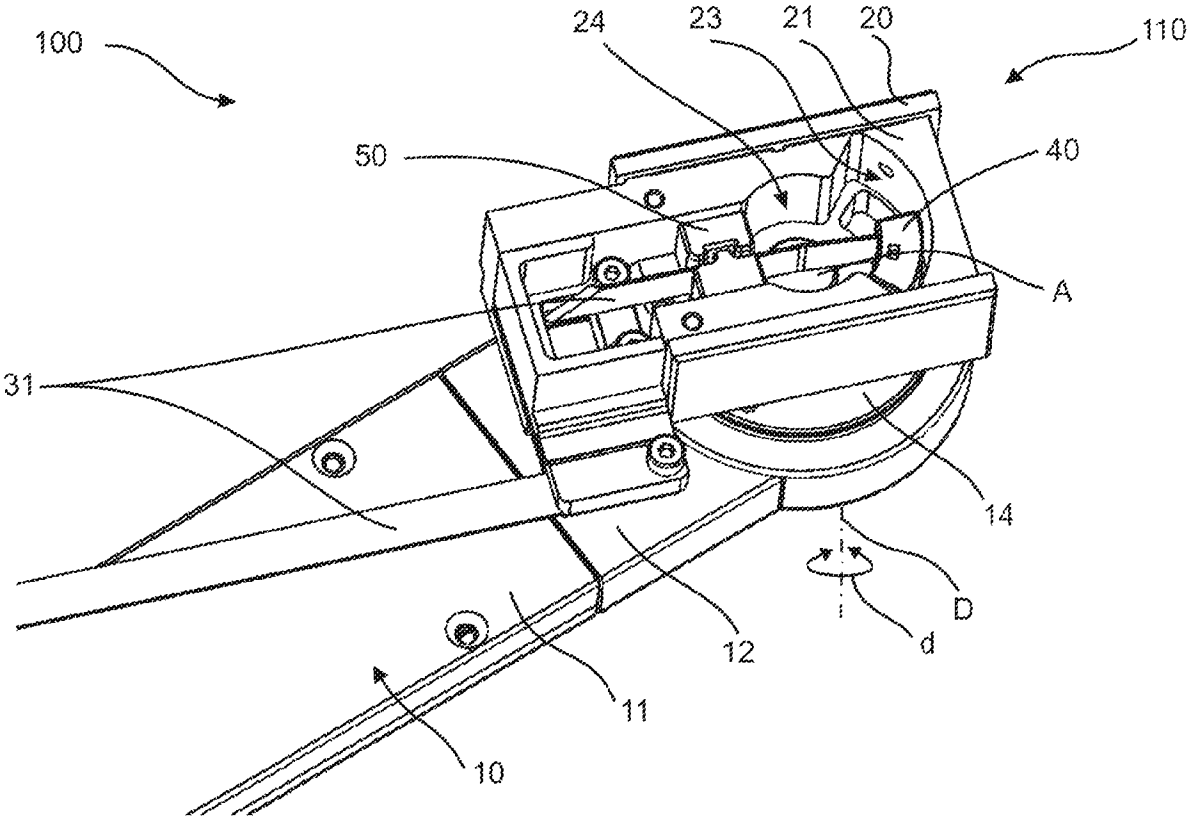
Figure 4:
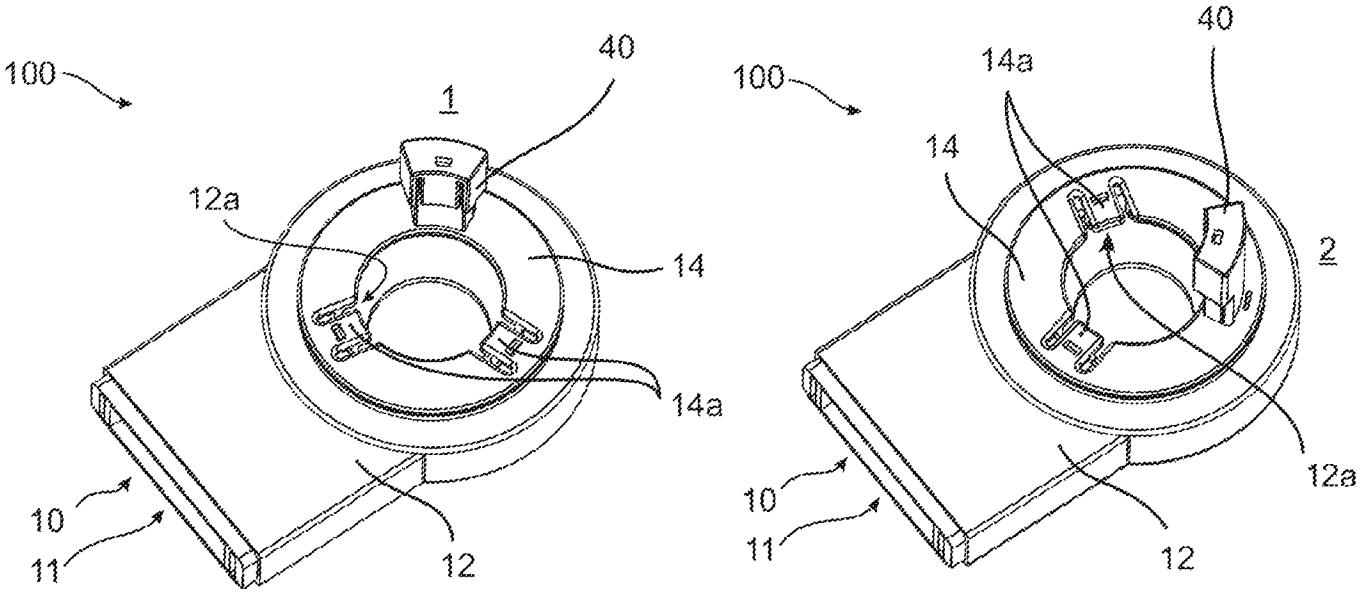

The FIGS. 1 and 3 show a device 100 in the sense of the disclosure, which is embodied for moving a door leaf 101 between an open position O and a close position S. For this purpose, the device 100 includes lever kinematics 10, which can be brought into operative connection with a guiding rail 20. Together the lever kinematics 10, a sliding member 21 and the guiding rail 20 form an inventive system 110.

Within the scope of the inventive device 100 as well as the inventive system 110, the lever kinematics 10 includes a lever 11, which at a first section 12 is rotatably connected to the sliding member 21, which can be linearly movably accommodated in the guiding rail 20. In this exemplary embodiment, the lever kinematics 10 corresponds to the lever 11. Thus, the first section 12 of the lever 11 establishes a mechanical operative connection between the rest of the lever kinematics 10 and the guiding rail 20.

Furthermore, the lever 11 includes a second section 13 for establishing a mechanical operative connection of the rest of the lever kinematics 10 to a drive 30. The drive 30 includes at least one energy recipient 32, such as e.g. a switch valve and/or an electric motor. The drive 30 can be embodied for assisting and/or for performing the movement of the door leaf 101 between the open position O and the close position S, for example as a mechanical or electrical door closer.

Most of the time, the connector to an energy source 22, e.g. in the shape of a power supply unit, is provided stationarily on a casing 102. In order to allow for a connection for transmitting electric energy and/or data between a casing-sided energy source 22 and at least one drive-sided energy recipient 32, a transmission means 31 is provided. The transmission means 31 represents a part of the inventive device 100 and of the inventive system 110.

In this case, the transmission means 31 needs to be laid between the casing-sided energy source 22 and the drive-sided energy recipient 32 over the guiding rail 20 and the lever kinematics 10.

The transmission means 31 can include a loop-shaped section 33, which can be disposed in the guiding rail 20 in order to allow the transmission means 31 to follow, when moving the sliding member 21 along the guiding rail 20.

At the transition between the lever kinematics 10 and the guiding rail 20, the transmission means 31 passes through the sliding member 21 and a connecting element 40 at the lever 11. In addition to the lever kinematics 10 and the transmission means 31, the connecting element 40 is a part of the inventive device 100.

When the lever 11 moves in relation to the sliding member 21, the relative position of the connecting element 40 to the sliding member 21 changes. In order to allow for said movement, a functional reception 23, in particular circle segment shaped, is formed in the sliding member 21.

Figure 2:
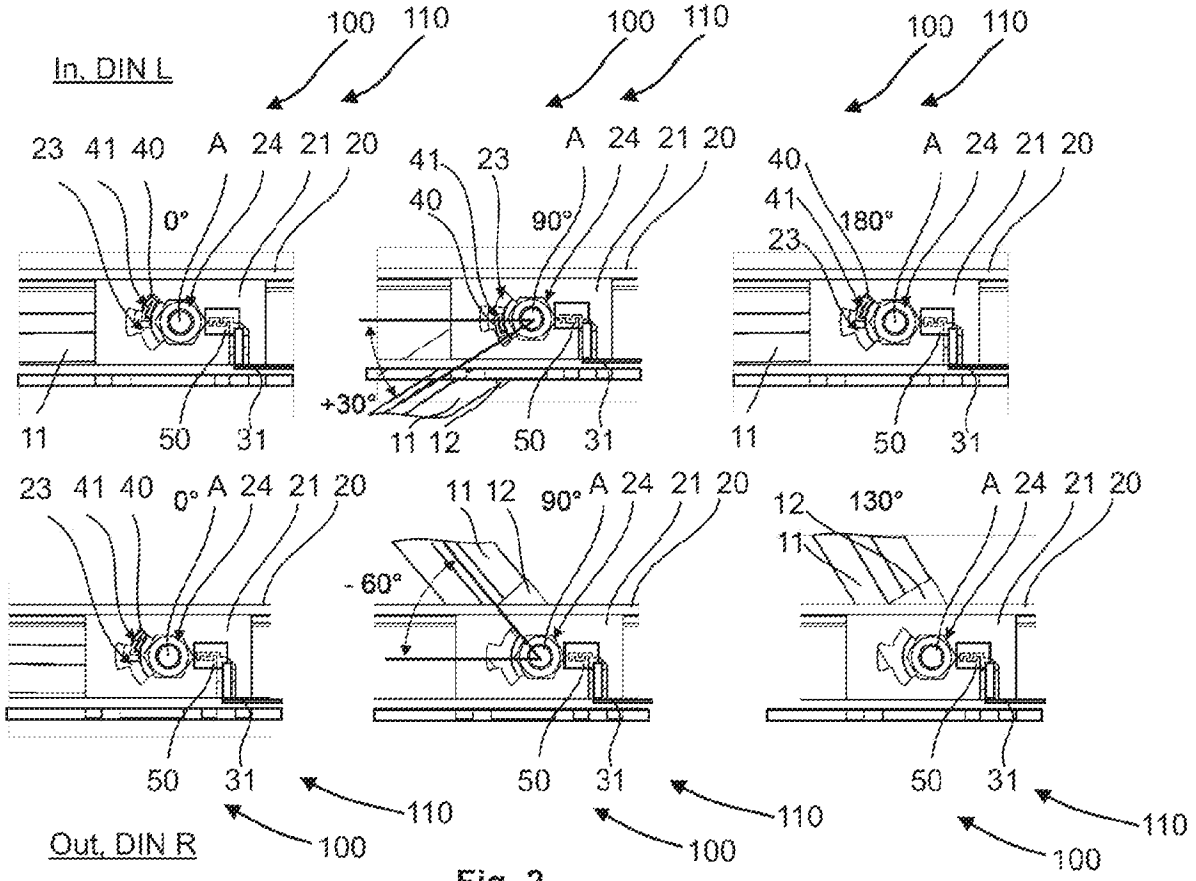
Figure 8:
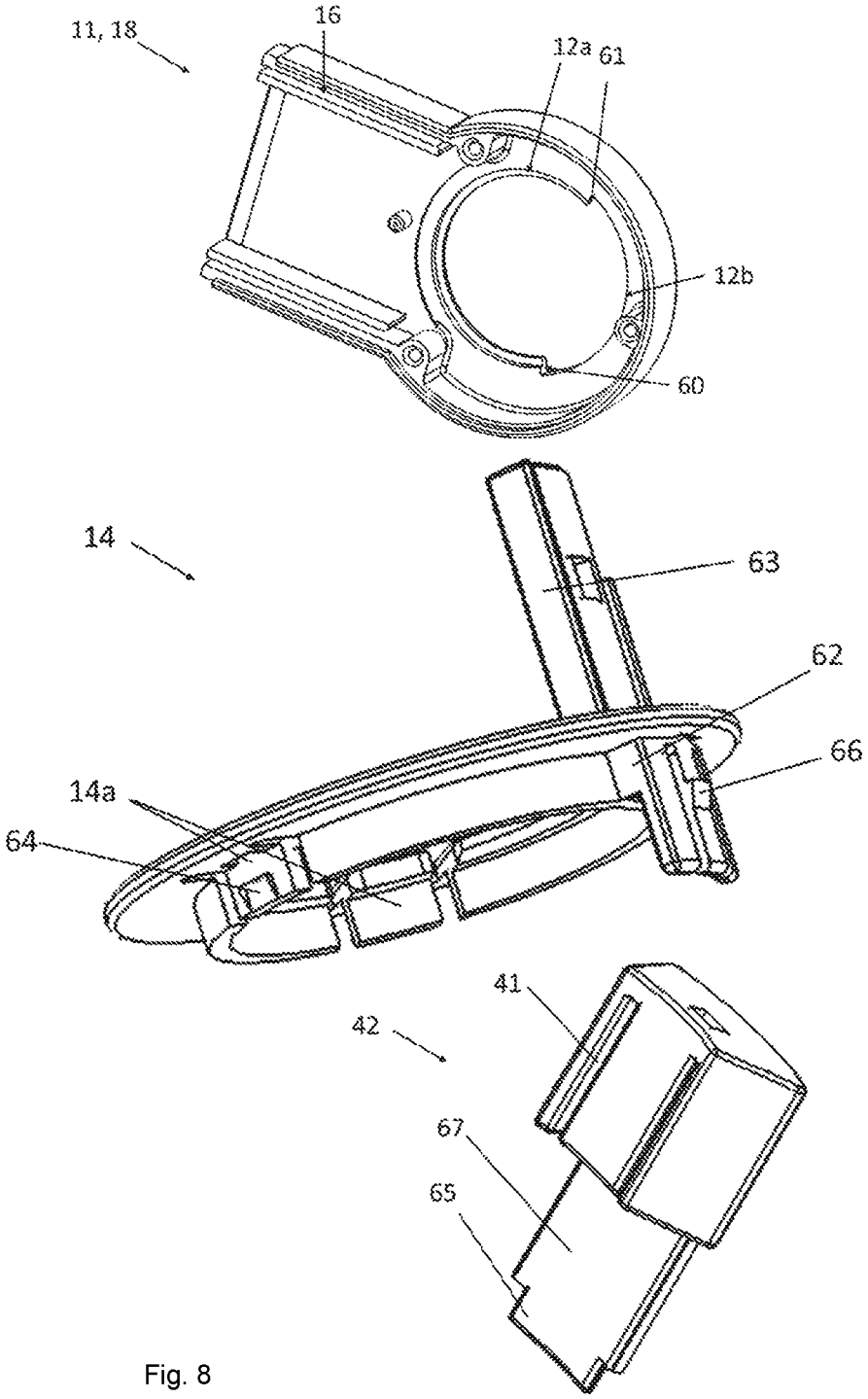
Figure 9:
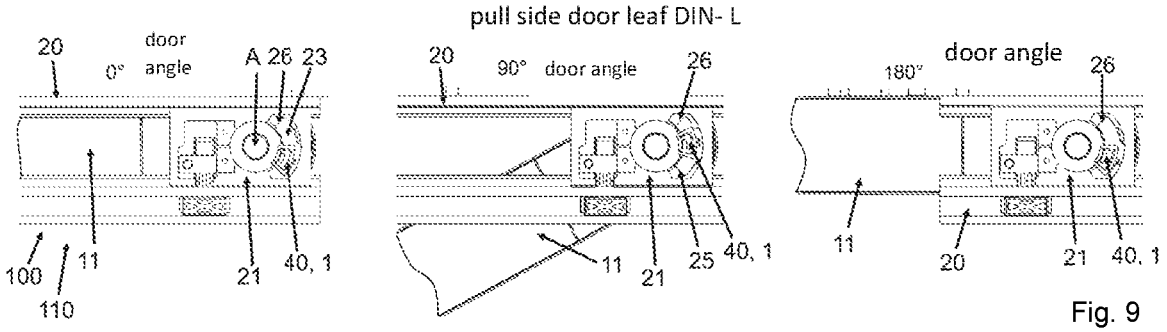

FIG. 2 top row and FIG. 9 illustrate how an inventive system 110 with an inventive device 100 functions when mounting the device 100 to a DIN left-handed door leaf 101 on a pull side. Hereby, the door is closed in the left depiction of FIG. 2 top row and of FIG. 9. The lever 11 is parallel to the guiding rail 20. The connecting element 40 is in a first start position 1 with regard to the lever 11 and in a first end location within the functional reception 23. In the first start position 1, the connecting element 40 rests at a first abutment 60 of the lever 11 (see FIG. 8). As an alternative, in the first start position 1, the connecting element 40 can be located near the first abutment 60 of the lever 11. In the first end location, the connecting element 40 is near a first sidewall 25 of the functional reception 23.

In the middle depiction of the top row of FIG. 2 and of FIG. 9, the door is opened by about 90°. The lever 11 is disposed angled to the guiding rail 20. The connecting element 40 remained in the first start position 1 with regard to the lever 11. However, the connecting element 40 is located in a second end location within the functional reception 23. Hereby, the connecting element 40 is located near a second sidewall 26 of the functional reception.

In the right depiction of the top row of FIG. 2 and of FIG. 9, the door is completely opened. Again, the lever 11 is disposed parallel to the guiding rail 20. On account of friction contact, the connecting element 40 has remained in the first start position 1 with regard to the lever 11. The connecting element 40 moved back to the first end location within the functional reception 23 and is located near the first sidewall 25.

The lower row of FIG. 2 illustrates a conceptual experiment. Now, the device 100 is mounted to a DIN right-handed R door leaf, on the push side OUT. Unlike in the inventive device, the connecting element 40 is still located in the start position 1. With the door being closed, like illustrated in the left depiction of the lower row of FIG. 2, said arrangement is still possible. However, in case now the door is opened and the lever 11 is pivoted, as illustrated in the middle and right depiction of the lower row of FIG. 2, the lever 11 presses the immobile connecting element 40 of the conceptual experiment against the first sidewall 25 and breaks.

The system 110 would have a different behaviour, if, in the left depiction of the lower row of FIG. 2, the connecting element 40 would be in a second start position 2 with regard to the lever 11, as inventively intended. This is illustrated in FIG. 12, as described in the following.

Figure 12:
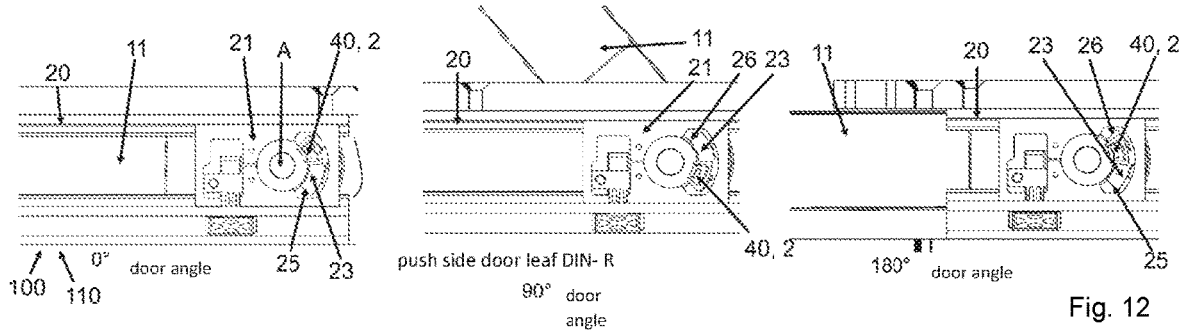

In FIG. 12, the inventive device 100 and the inventive system 110 are mounted on a pull side of a DIN R door leaf 101. In the left depiction of FIG. 12, analogously to FIG. 9, the door is closed, in the middle depiction of FIG. 12 the door is opened by about 90° and in the right depiction of FIG. 12 by about 180°.

In all depictions of FIG. 12, the connecting element 40 is located in the second start position 2. In the second start position 2, the connecting element 40 rests at a second abutment 61 of the lever 11 (see FIG. 8). As an alternative, the connecting element 40 is located in the second start position 2 near the second abutment 61. In the left depiction of FIG. 12, the lever 11 is located parallel to the guiding rail 20 and the connecting element 40 is located near the second sidewall 26. The connecting element 40 is located in the second end location. When the door is opened by about 90°, the lever 11 moves. Hereby, the connecting element 40 remains in the second start position. Moving the lever 11 causes the connecting element 40 to move as well until the connecting element 40 is located near the first sidewall 25.

Now, the connecting element 40 is located in the first end location. As the connecting element 40 is located in the second start position and not in the first start position, moving the connecting element 40 is possible without breaking off. With a further opening movement, the angle decreases between the lever 11 and the guiding rail 20. In the right depiction of FIG. 12, the lever 11 is again located parallel to the guiding rail 20. The connecting element 40 moved back to the second end location within the functional reception 23 and is located near the second sidewall 26.

Changing the start positions 1, 2 according to the desired mounting type DIN R or DIN L corresponds to the inventive method.

Figure 10:
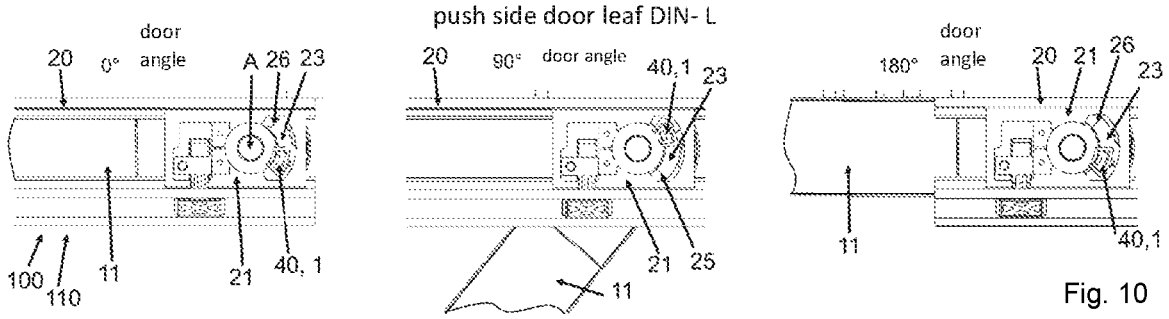

FIG. 10 shows the movement of the lever 11 when opening the door analogously to FIG. 9 for DIN L doors. In contrast to FIG. 9, the lever is disposed on the push side.

Figure 11:
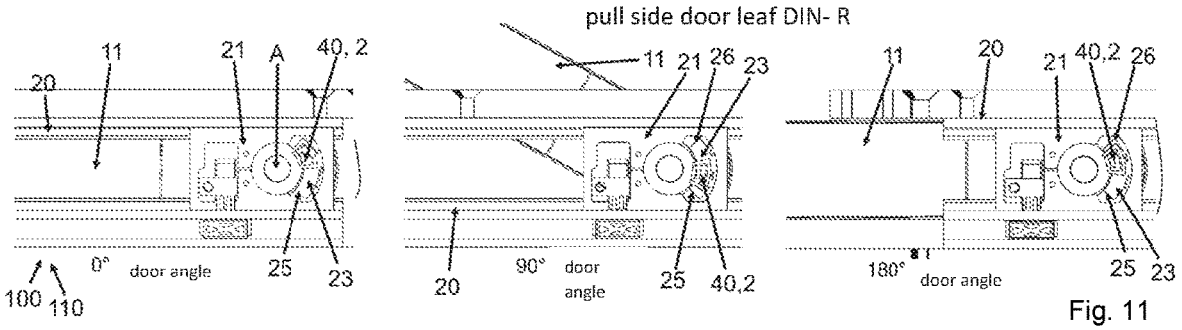

FIG. 11 shows the movement of the lever 11 when opening the door analogously to FIG. 12 for DIN R doors. In contrast to FIG. 12, the lever is disposed on the pull side.

Both the comparison of FIGS. 9 and 10 and the comparison of FIGS. 11 and 12 result in that the first end location with push side mounting is located closer to the first sidewall 25 than with pull side mounting. With push side mounting, the second end location is located closer to the second sidewall 26 than with pull side mounting. The abutments 60, 61 and the size of the functional reception 23 as well are dimensioned such as to prevent the connecting element 40 from breaking off with push side mounting.

In the event the connecting element 40 can not only be disposed in the two start positions 1, 2, but moreover rotatably mobile supported at the lever 11, the following advantage results:

When using the device 100 for the first time and the connecting element 40 is located at the incorrect start position 1, 2, which without rotary mobility of the connecting element 40 results in the connecting element 40 breaking off (see left lower depiction of the FIG. 2), the connecting element 40 moves to the correct start position 1, 2 without an installer intervening. For example, in the left lower depiction of FIG. 2, the connecting element 40 is located in the incorrect start position 1, which without rotary mobility of the connecting element 40 would result in the connecting element 40 breaking off (see middle lower depiction of FIG. 2). On account of the rotary mobility of the connecting element 40, the connecting element 40 is pressed against the first sidewall 25, while the lever 11 moves from the location of the left lower depiction in FIG. 2 to the location of the middle lower depiction of FIG. 2. However, on account of the rotary mobility of the connecting element 40, the connecting element 40 does not break off, unlike illustrated in FIG. 2, but moves to the second start position 2. When closing the door, the device reaches the position according to FIG. 12 without the installer intervening, left hand depiction. During subsequent operation, the connecting element 40 remains in the start position 2. Now as illustrated in FIG. 12, the connecting element 40 can move. Said procedure corresponds to a particularly preferred inventive method.

Furthermore, based on the rotatable support of the connecting element 40 at the lever 11, when opening the door, it is possible for the connecting element 40 not to remain in the respective start position 1, 2, but in particular to slightly turn. Hereby allowing for compensating fault tolerances.

In other words: As obvious in FIG. 2, problems can arise when mounting the device 100 to a DIN left-handed L or to a DIN right-handed R door leaf 101. Depending on the mounting type of the lever kinematics 10, the relative rotation between the sliding member 21 and the lever 11 amounts to about 30° on the pull side IN and to about 60° on the push side OUT. In case the lever kinematics 10 is disposed to a DIN left-handed L or to a DIN right-handed R door leaf 101, additionally, the relative direction of rotation reverses between the sliding member 21 and the lever 11. Consequently, the relative movement between the sliding member 21 and the lever 11 can amount to up to about 120° or more to up to 140°. Often a corresponding movement of the connecting element 40 within the sliding member 21 is not possible, based on the lacking construction space within the guiding rail 20 and thus of the sliding member 21. As shown at the bottom in the middle view in FIG. 2, within the existing functional reception 23 in the sliding member 21, the connecting element 40 can collide with the guiding rail 20 and even break off.

Therefore, conventional devices require at least two lever kinematics 10 variants with the stationary connecting element 40, one for a DIN left-handed L door leaf 101 and one fora DIN right-handed R door leaf 101.

The disclosure overcomes the above-mentioned disadvantages and provides a device 100, which can be embodied as shown in FIGS. 4 to 12. According to the disclosure, for this purpose it is provided for the connecting element 40 to be disposed in the first and in the second start positions 1, 2. The connecting element 40 is rotatably supported, in particular at least between two different start positions 1, 2, at a first section 12 of the lever 11, which for example can be in a range of maximum +/−50°, in particular maximum +/−40° with regard to the longitudinal extension axis of the lever 11, wherein said ranges can be marked by abutments 60, 61 in a guide 12*a* at the first section 12 of the lever 11.

The rotatable support of the connecting element 40 at the lever 11 creates an additional degree of freedom for flexibly mounting the connecting element 40 to the lever 11. In this way, the connecting element 40 can be positioned at the lever 11 in different start positions 1, 2 in a simple and optional manner, depending on the desired mounting type. Moreover, when operating the device 100, the connecting element 40 does not necessarily have to remain in one of the start positions 1, 2. Rather, a slight rotation allows for compensating a fault.

The respective mounting type can comprise mounting to a DIN left-handed L or a DIN right-handed R door leaf 101, on a pull side IN or on a push side OUT of the door leaf 101. Thus, the necessary turning of the sliding member 21 in relation to the lever 11 by at least 120° (respectively at least in a range of +/−60°) is possible. The connecting element 40 can be manually brought into the respective appropriate start position 1, 2 and/or the sliding member 21 can automatically turn it. Advantageously, the disclosure does not require any modifications at the sliding member 21 and/or in the guiding rail 20.

The connecting element 40 can comprise a guiding element 42 and an adapter element 14. The guiding element 42 is reversibly releasably connected to the adapter element 14. According to an embodiment of the disclosure of FIG. 4, the adapter element 14 can be rotatably supported along a guide 12*a* at the first section 12 of the lever 11. According to another embodiment of the disclosure and the idea of FIG. 4, the adapter element 14 can include at least one sliding element 14*a*, which is rotatably accommodated at a guide 12*a* at the first section 12 of the lever 11.

Figure 7:
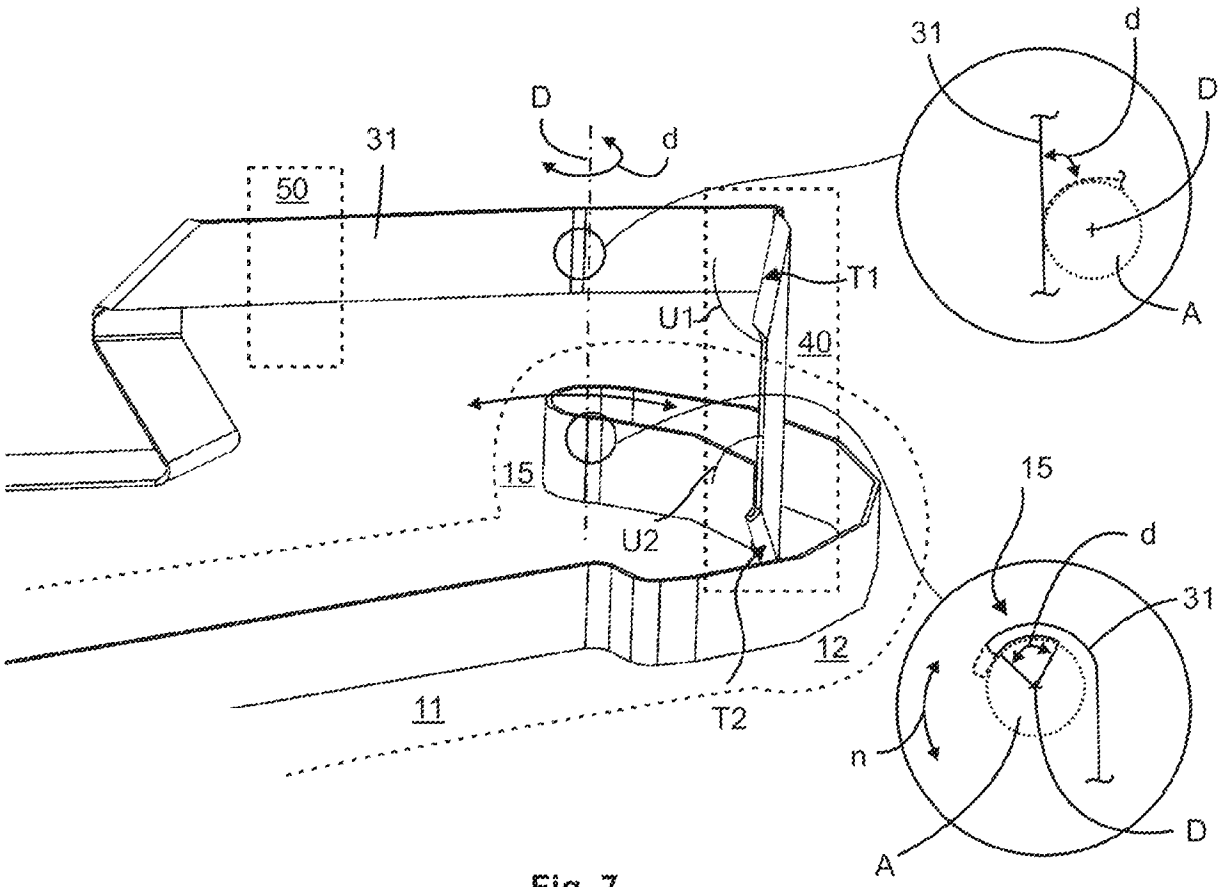

As illustrated in FIG. 2 and in FIG. 8, the connecting element 40 can be embodied with a plug-in guide 41 for the transmission means 31. For example, the plug-in guide 41 can serve for deflecting the transmission means 31 at least once, preferably twice, in particular by 90° and/or for deflecting at least once, preferably twice, in particular by 45°. Deflecting and/or folding back the transmission means 31 at least once, preferably twice (compare FIG. 7) can allow for laying the transmission means 31 along a branch-type arrangement between the lever 11 and the guiding rail 20, which moreover can have different construction heights. Moreover, the plug-in guide 41 can effect strain relief at the transmission means 31.

As indicated in FIG. 7, at least section-wise the inventive transmission means 31 can be configured as a flat cable, flat ribbon cable or a flexible printed circuit board. Basically however, a round cable is conceivable as well as the transmission means 31.

As shown in the middle of FIG. 7, uniquely featuring the transmission means 31, the transmission means 31 can have at least one, preferably two deflection points U1, U2, in particular by 90°, and/or at least one, preferably two fold back points T1, T2, in particular by 45°, which can be based on the reception in the plug-in guide 41 at the connecting element 40. On account of the plug-in guide 41, the transmission means 31 can be affixed to the connecting element 40 without additional attachment means as well as under strain relief.

Figure 5:
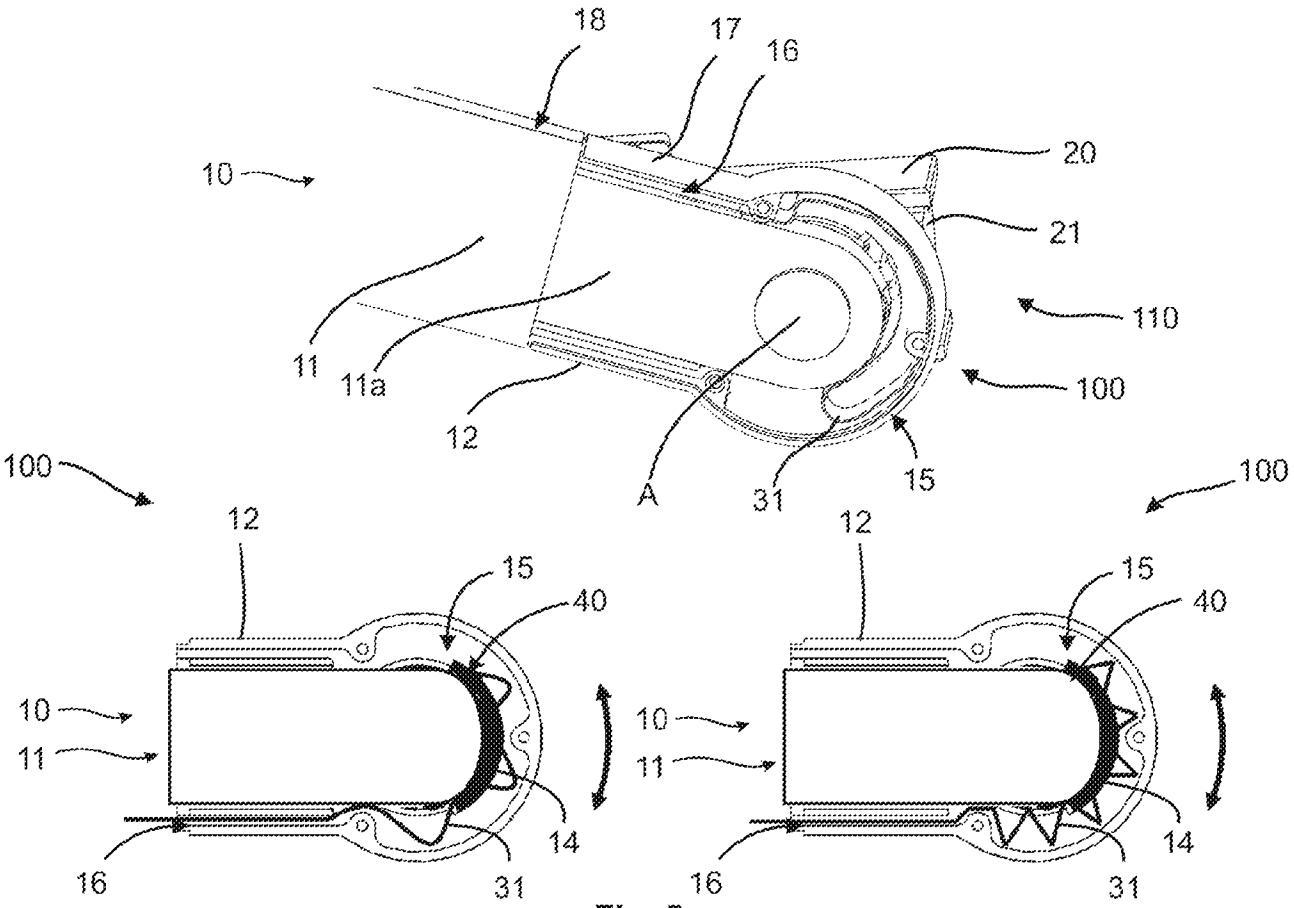
Figure 6:
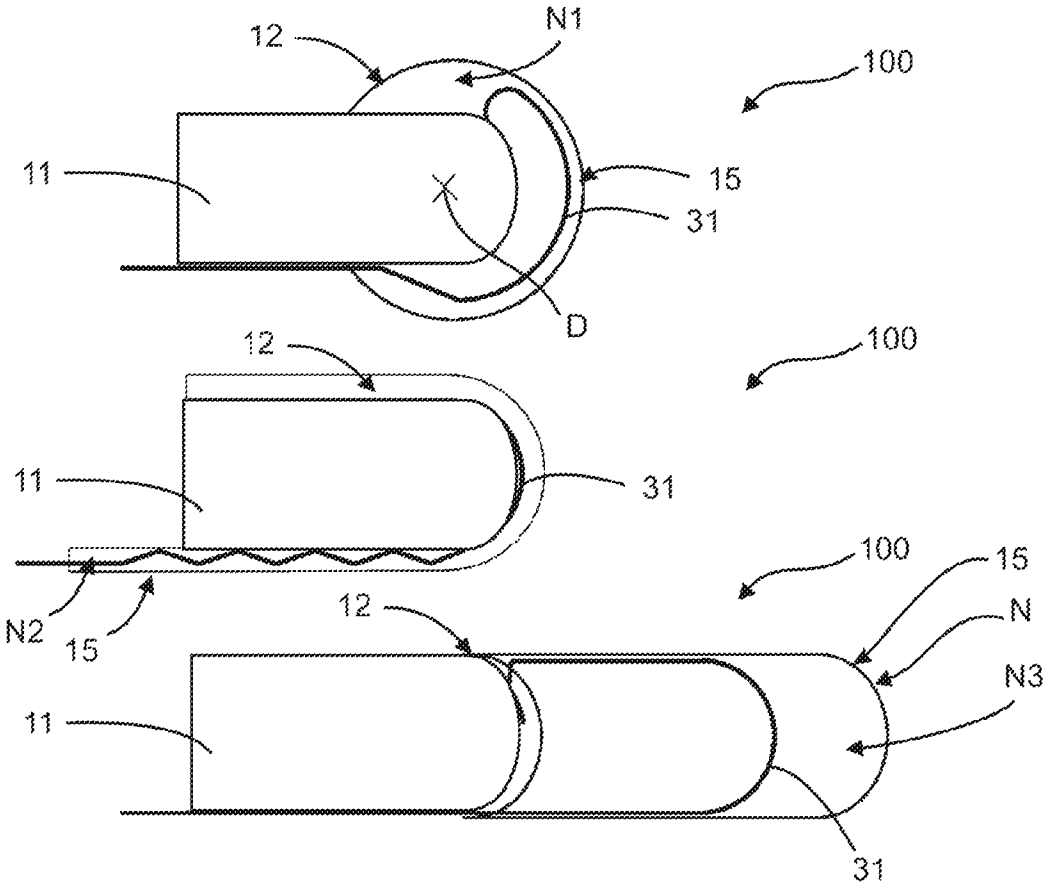

As furthermore shown in the FIGS. 5 to 7, according to an advantage of the disclosure, a storage unit 15 can be provided in or at the lever 11 for accommodating a length of the transmission means 31, in order to allow for adjusting n the transmission means 31 when turning the connecting element 40 in relation to the lever 11 (compare enlarged view at the bottom right in FIG. 7).

As indicated in the different views of FIG. 5, the length of the transmission means 31, which the storage unit 15 can accommodate for adjusting n the transmission means 31, can be folded in a loop shape, respectively U shape, meander shape or accordion shape.

Likewise, the storage unit 15 can be realized differently, as diagrammatically shown in FIG. 6. As shown above in FIG. 6, the storage unit 15 can be formed in the shape of a circle segment shaped groove N1 in the first section 12 of the lever 11, which in particular extends around an axis of rotation D of the lever 11 with regard to the guiding rail 20.

As shown in the middle of FIG. 6, the storage unit 15 can be formed in the shape of a linear groove N2, for example, which extends along an extension axis of the lever 11. As shown at the bottom in FIG. 6, the storage unit 15 can be formed in the shape of a reception N3 at a separate add-on piece N, in particular rotationally mobile supported at the lever 11, in particular for the first section 12 of the lever 11.

Furthermore, as shown in FIG. 5, the lever 11 can include a guiding groove 16, potentially with a groove cover 17 for the transmission means 31, in order to accommodate the transmission means 31 in a protected manner in the lever 11. Furthermore, it is conceivable for the lever 11 to include a metal core 11*a* and a plastic material housing 18, wherein in particular the guiding groove 16 can be formed between the metal core 11*a* and the plastic material housing 18. In this case, the groove cover 17 can correspond to the plastic material housing 18.

As already mentioned above in conjunction with the FIGS. 1 and 3, a system 110 for moving a door leaf 101 between an open position O and a close position S with regard to the door opening 104 in a wall 103 is a further aspect of the disclosure. In this case, the system 110 includes a device 100, which can be embodied as described above, and a guiding rail 20, in which a sliding member 21 is movably accommodated, wherein the sliding member 21 is rotatably connected to the first section 12 of the lever 11.

As shown in FIG. 3, within the scope of the inventive system 110, the sliding member 21 can include a functional reception 23 for the connecting element 40, in order to allow for a displacement of the connecting element 40 during a rotary movement d of the lever 11 in relation to the sliding member 21 (the rotary movement d of the lever 11 is indicated in the FIG. 7). Furthermore, the sliding member 21 can include a rotary reception 24 for a rotary head A of the lever 11, in order to allow for a rotary movement d of the lever 11 in relation to the sliding member 21. In this case, it is conceivable for the rotary reception 24 to be formed continuously with the functional reception 23. Moreover, it is conceivable for the transmission means 31 to pass centrally through a rotary reception 24 located at the sliding member 21 for a rotary head A of the lever 11.

Furthermore, as shown in FIG. 3, a guiding unit 50 can be provided for the transmission means 31 at the sliding member 21. For example, the guiding unit 50 can be provided following the functional reception 23 for the connecting element 40 and following the rotary reception 24 for a rotary head A of the lever 11, prior to introducing the transmission means 31 into the guiding rail 20. The guiding unit 50 can be formed to prevent the transmission means 31 from moving to the top or to the bottom out of the sliding member 21, in the view of FIG. 3. For this purpose, at the top and at the bottom, limitation hooks, which are just diagrammatically indicated in the FIGS. 2 and 3, can be provided in the guiding unit 50.

FIG. 8 individually illustrates a part of the lever 11, in particular of the plastic material housing 18, the adapter element 14 and the guiding element 42. The combined view of the lever 11 and of the adapter element 14 result in showing the projections 64 of the sliding elements 14*a* engage behind the guide 12*a* of the lever 11. Hereby, the connecting element 40 is captively supported at the lever 11. Only one projection 64 is depicted of all the projections 64 in FIG. 8. Additionally, a further projection 66 engages behind a further guide 12*b* of the lever 11.

The adapter element 14 comprises abutment surfaces 62, from which only one abutment surface 62 is depicted in FIG. 8. The adapter element 14 with respectively one of the abutment surfaces 62 can contact one of the abutments 60, 61 of the lever 11.

The adapter element 14 comprises a mandrel 63. In the mounted condition, the hood-shaped guiding element 42 is fitted over the mandrel. With an attachment section 65, the guiding element 42 is attached to the adapter element 14. In particular, the guiding element 42 with the attachment section 65 is inserted or clipsed into the adapter element 14.

The guiding element 42 comprises a plug-in guide 41. The guiding element 42 comprises a guiding surface 67. The transmission means 31 is fitted through the plug-in guide 41. The transmission means 31 is guided between the guiding surface 67 and the mandrel 63.

The preceding description of the Figures describes the present disclosure exclusively on the basis of examples. Obviously, individual features of the embodiments, as long as they are technically reasonable, can be freely combined with each other without departing from the scope of the present disclosure.

The invention claimed is:

1. A device for moving a door leaf between an open position and a close position with regard to a door opening in a wall, the device comprises:

a lever adapted to be connected to the door leaf via a drive for assisting movement of the door leaf, wherein the lever includes a first section and a second section, and a connecting element adapted to be connected to the wall via a guiding rail for receiving a transmission means for transmitting electrical energy and/or data, wherein the connecting element is configured to be disposed between at least two different start positions, at a first start position with respect to the first section of the lever and at a second start position with respect to the first section of the lever, and wherein the connecting element is rotatably supported at the first section of the lever.

2. The device according to claim 1, wherein the connecting element is supported in a range of maximum +/−55° with regard to the longitudinal extension axis of the lever.

3. The device according to claim 1, wherein the lever comprises at least a first abutment to delimit movement of the connecting element.

4. The device according to claim 1, wherein the device comprises the transmission means configured to be disposed in a storage unit in the first section of the lever, and the storage unit is provided for receiving a loose length of the transmission means, in order to allow for adjusting the transmission means when the connecting element rotates at the first section at the lever.

5. The device according to claim 4, wherein the storage unit in the form of a circle segment shaped groove is formed in the first section of the lever, which extends about an axis of rotation of the lever or the storage unit is formed in the shape of a linear groove in the lever or in the storage unit is formed in the shape of a reception at a separate add-on piece, rotatably mobile supported at the lever, for the first section of the lever.

6. The device according to claim 4, wherein that a length of the transmission means, which is accommodated in the storage unit, is configured in a loop shape, in a meander shape, or in an accordion shape.

7. The device according to claim 1, wherein the lever includes a guiding groove for the transmission means, wherein the guiding groove is formed between a core of the lever and a housing of the lever and/or is formed within the housing.

8. The device according to claim 1, wherein the connecting element, includes a plug-in guide for the transmission means, wherein the plug-in guide is embodied for deflecting the transmission means at least once by 90°, or to fold it back at least once by 45°.

9. The device according to claim 1, wherein the device includes the transmission means and the transmission means is configured at least section-wise as a flat cable, a flat ribbon cable, or a flexible printed circuit board.

10. The device according to claim 9, wherein the transmission means includes at least one deflection point by 90°, or at least one fold back point by 45°, at the connecting element.

11. The device according to claim 1, wherein the connecting element comprises an adapter element, wherein the adapter element is rotatably supported along a guide at the first section of the lever, wherein the guiding element is reversibly releasably attached to the adapter element.

12. A system for moving a door leaf between an open position and a close position with regard to a door opening in a wall, the system comprises:

a device according to claim 1, a sliding member and a guiding rail, in which a sliding member is movably accommodated, wherein the sliding member is rotatably connected to the first section of the lever.

13. The system according to claim 12, wherein the sliding member includes a functional reception, in the shape of a circle segment, for the connecting element in order to allow for displacing the connecting element, in a range of maximum +/−60° with regard to the longitudinal extension axis of the lever, during a rotary movement of the lever in relation to the sliding member, wherein the connecting element as it rests at a sidewall of the functional reception is movable from one start position to a further start position.

14. The system according to claim 13, wherein the sliding member includes a rotary reception for a rotary head of the lever, in order to allow for a rotary movement of the lever in relation to the sliding member, wherein the rotary reception is formed continuously with the functional reception, and/or in the transmission means passes centrally through the rotary reception at the sliding member for a rotary head of the lever, wherein the device includes the transmission means and the transmission means is configured at least section-wise as a flat cable, a flat ribbon cable, or a flexible printed circuit board.

15. The system according to claim 12, wherein that, at the sliding member, a guiding unit is provided for the transmission means.

16. The system according to claim 12, wherein the device includes the transmission means configured at least section-wise as a flat cable, a flat ribbon cable, or a flexible printed circuit board, the transmission means includes a loop-shaped section, which is disposed in the guiding rail, in order to allow for the transmission means to follow when moving the sliding member along the guiding rail.

17. A method for mounting the device for moving a door leaf between an open position and a close position with regard to a door opening in a wall, according to claim 1, the method including the following steps:

moving the door leaf using a lever, wherein the lever includes a first section and a second section, receiving a transmission means for transmitting electrical energy and/or data using a connecting element, and adapting the device to a DIN left-handed door leaf or a DIN right-handed door leaf, on a pull side (IN) or on a push side (OUT) of the door leaf by disposing the connecting element at a first start position intended for the connecting element or at a second start position intended for the connecting element at a first section of the lever.

* * * * *